US009404349B2

(12) United States Patent
Zhao

(10) Patent No.: US 9,404,349 B2
(45) Date of Patent: Aug. 2, 2016

(54) AUTONOMOUS FLUID CONTROL SYSTEM HAVING A FLUID DIODE

(71) Applicant: Liang Zhao, Plano, TX (US)

(72) Inventor: Liang Zhao, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 829 days.

(21) Appl. No.: 13/657,371

(22) Filed: Oct. 22, 2012

(65) Prior Publication Data

US 2014/0110127 A1 Apr. 24, 2014

(51) Int. Cl.
*E21B 43/12* (2006.01)
*E21B 34/08* (2006.01)

(52) U.S. Cl.
CPC ..... *E21B 43/12* (2013.01); *E21B 34/08* (2013.01)

(58) Field of Classification Search
CPC ..... E21B 43/12; E21B 43/32; E21B 43/14; E21B 17/18; E21B 34/08; F15C 1/16
USPC ..... 137/808, 809
See application file for complete search history.

(56) References Cited

U.S. PATENT DOCUMENTS

| | | | |
|---|---|---|---|
| 553,727 | A | 1/1896 | Van Sickle |
| 1,329,559 | A | 2/1920 | Tesla |
| 2,140,735 | A | 12/1938 | Clarke |
| 2,324,819 | A | 6/1941 | Butzbach |
| 2,762,437 | A | 9/1956 | Egan |
| 2,849,070 | A | 8/1958 | Maly |
| 2,945,541 | A | 7/1960 | Maly |
| 2,981,332 | A | 4/1961 | Miller |
| 2,981,333 | A | 4/1961 | Miller |
| 3,091,393 | A | 5/1963 | Sparrow |
| 3,186,484 | A | 6/1965 | Waterman |
| 3,216,439 | A | 11/1965 | Manion |
| 3,233,621 | A | 2/1966 | Manion |
| 3,233,622 | A | 2/1966 | Boothe |

(Continued)

FOREIGN PATENT DOCUMENTS

| | | |
|---|---|---|
| EP | 0834342 B1 | 1/1999 |
| EP | 1672167 A1 | 6/2006 |

(Continued)

OTHER PUBLICATIONS

European Search Report, Application No. EP 13 18 2098, Mail Date Nov. 13, 2013, 8 pages.

(Continued)

*Primary Examiner* — Robert E Fuller
*Assistant Examiner* — David Carroll
(74) *Attorney, Agent, or Firm* — Haynes and Boone, LLP

(57) ABSTRACT

Apparatus and methods for autonomously controlling fluid flow in a subterranean well are presented, and in particular for providing a fluid diode to create a relatively high resistance to fluid flow in one direction and a relatively low resistance to fluid flowing in the opposite direction. The diode is positioned in a fluid passageway and has opposing high resistance and low resistance entries. In one embodiment, the high resistance entry has a concave, annular surface surrounding an orifice and the low resistance entry has a substantially conical surface. The concave, annular surface of the high resistance entry preferably extends longitudinally beyond the plane of the orifice. In a preferred embodiment, the fluid will flow in eddies adjacent the concave, annular surface.

20 Claims, 5 Drawing Sheets

(56) References Cited

U.S. PATENT DOCUMENTS

| | | | |
|---|---|---|---|
| 3,256,899 | A | 6/1966 | Dexter |
| 3,266,510 | A | 8/1966 | Wadey |
| 3,267,946 | A | 8/1966 | Adams |
| 3,282,279 | A | 11/1966 | Manion |
| 3,375,842 | A | 4/1968 | Reader |
| 3,427,580 | A | 2/1969 | Brock |
| 3,461,897 | A | 8/1969 | Kwok |
| 3,470,894 | A | 10/1969 | Rimmer |
| 3,474,670 | A | 10/1969 | Rupert |
| 3,477,506 | A | 11/1969 | Malone |
| 3,486,975 | A | 12/1969 | Ripley |
| 3,489,009 | A | 1/1970 | Rimmer |
| 3,515,160 | A | 6/1970 | Cohen |
| 3,521,657 | A | 7/1970 | Ayers |
| 3,529,614 | A | 9/1970 | Nelson |
| 3,537,466 | A | 11/1970 | Chapin |
| 3,554,209 | A | 1/1971 | Brown |
| 3,566,900 | A | 3/1971 | Black |
| 3,575,804 | A | 4/1971 | Ripley |
| 3,586,104 | A | 6/1971 | Hyde |
| 3,598,137 | A | 8/1971 | Glaze |
| 3,620,238 | A | 11/1971 | Kawahata |
| 3,638,672 | A | 2/1972 | Smith |
| 3,643,676 | A | 2/1972 | Limage |
| 3,667,234 | A | 6/1972 | De Lizasoain |
| 3,670,753 | A | 6/1972 | Healey |
| 3,704,832 | A | 12/1972 | Fix |
| 3,712,321 | A | 1/1973 | Bauer |
| 3,717,164 | A | 2/1973 | Griffin |
| 3,730,673 | A | 5/1973 | Straitz |
| 3,745,115 | A | 7/1973 | Olsen |
| 3,754,576 | A | 8/1973 | Zettrestrom |
| 3,756,285 | A | 9/1973 | Johnson |
| 3,776,460 | A | 12/1973 | Fichter |
| 3,850,190 | A | 11/1974 | Carlson |
| 3,860,519 | A | 1/1975 | Weatherford |
| 3,876,016 | A | 4/1975 | Stinson |
| 3,885,627 | A | 5/1975 | Berry et al. |
| 3,895,901 | A | 7/1975 | Schwartz |
| 3,927,849 | A | 12/1975 | Kovalenko |
| 3,942,557 | A | 3/1976 | Tsuchiya |
| 4,003,405 | A | 1/1977 | Haynes |
| 4,029,127 | A | 6/1977 | Thompson |
| 4,082,169 | A | 4/1978 | Bowles |
| 4,127,173 | A | 11/1978 | Watkins |
| 4,134,100 | A | 1/1979 | Funke |
| 4,138,669 | A | 2/1979 | Edison |
| 4,167,073 | A | 9/1979 | Tang |
| 4,167,873 | A | 9/1979 | Bahrton |
| 4,187,909 | A | 2/1980 | Erbstoesser |
| 4,268,245 | A | 5/1981 | Straitz, III |
| 4,276,943 | A | 7/1981 | Holmes |
| 4,279,304 | A | 7/1981 | Harper |
| 4,282,097 | A | 8/1981 | Kuepper |
| 4,286,627 | A | 9/1981 | Graf |
| 4,287,952 | A | 9/1981 | Erbstoesser |
| 4,291,395 | A | 9/1981 | Holmes |
| 4,303,128 | A | 12/1981 | Marr, Jr. |
| 4,307,204 | A | 12/1981 | Vidal |
| 4,307,653 | A | 12/1981 | Goes |
| 4,323,118 | A | 4/1982 | Bergmann |
| 4,323,991 | A | 4/1982 | Holmes |
| 4,345,650 | A | 8/1982 | Wesley |
| 4,364,232 | A | 12/1982 | Sheinbaum |
| 4,364,587 | A | 12/1982 | Samford |
| 4,385,875 | A | 5/1983 | Kanazawa |
| 4,390,062 | A | 6/1983 | Fox |
| 4,393,928 | A | 7/1983 | Warnock, Sr. |
| 4,396,062 | A | 8/1983 | Iskander |
| 4,418,721 | A | 12/1983 | Holmes |
| 4,442,903 | A | 4/1984 | Schutt |
| 4,467,833 | A | 8/1984 | Satterwhite |
| 4,485,780 | A | 12/1984 | Price |
| 4,491,186 | A | 1/1985 | Alder |
| 4,495,990 | A | 1/1985 | Titus |
| 4,518,013 | A | 5/1985 | Lazarus |
| 4,526,667 | A | 7/1985 | Parkhurst |
| 4,527,636 | A | 7/1985 | Bordon |
| 4,557,295 | A | 12/1985 | Holmes |
| 4,562,867 | A | 1/1986 | Stouffer |
| 4,570,675 | A | 2/1986 | Fenwick |
| 4,570,715 | A | 2/1986 | Van Meurs |
| 4,618,197 | A | 10/1986 | White |
| 4,648,455 | A | 3/1987 | Luke |
| 4,716,960 | A | 1/1988 | Eastlund |
| 4,747,451 | A | 5/1988 | Adams |
| 4,765,184 | A | 8/1988 | Delatore |
| 4,801,310 | A | 1/1989 | Bielefeldt |
| 4,805,407 | A | 2/1989 | Buchanan |
| 4,808,084 | A | 2/1989 | Tsubouchi |
| 4,817,863 | A | 4/1989 | Bragg |
| 4,846,224 | A | 7/1989 | Collins, Jr. |
| 4,848,991 | A | 7/1989 | Bielefeldt |
| 4,857,197 | A | 8/1989 | Young et al. |
| 4,895,582 | A | 1/1990 | Bielefeldt |
| 4,911,239 | A | 3/1990 | Winckler |
| 4,919,201 | A | 4/1990 | Bridges |
| 4,919,204 | A | 4/1990 | Baker |
| 4,921,438 | A | 5/1990 | Godfrey |
| 4,945,995 | A | 8/1990 | Tholance |
| 4,967,048 | A | 10/1990 | Langston |
| 4,974,674 | A | 12/1990 | Wells |
| 4,984,594 | A | 1/1991 | Vinegar |
| 4,998,585 | A | 3/1991 | Newcomer |
| RE33,690 | E | 9/1991 | Adams, Jr. |
| 5,058,683 | A | 10/1991 | Godfrey |
| 5,076,327 | A | 12/1991 | Mettner |
| 5,080,783 | A | 1/1992 | Brown |
| 5,099,918 | A | 3/1992 | Bridges |
| 5,154,835 | A | 10/1992 | Demichael |
| 5,165,450 | A | 11/1992 | Marrelli |
| 5,166,677 | A | 11/1992 | Schoenberg |
| 5,184,678 | A | 2/1993 | Pechkov |
| 5,202,194 | A | 4/1993 | Vanberg |
| 5,207,273 | A | 5/1993 | Cates |
| 5,207,274 | A | 5/1993 | Streich |
| 5,228,508 | A | 7/1993 | Facteau |
| 5,251,703 | A | 10/1993 | Skinner |
| 5,279,363 | A | 1/1994 | Schultz |
| 5,282,508 | A | 2/1994 | Ellingsen |
| 5,303,782 | A | 4/1994 | Johanessen |
| 5,332,035 | A | 7/1994 | Schultz |
| 5,333,684 | A | 8/1994 | Walter |
| 5,337,808 | A | 8/1994 | Graham |
| 5,337,821 | A | 8/1994 | Peterson |
| 5,338,496 | A | 8/1994 | Talbot |
| 5,341,883 | A | 8/1994 | Ringgenberg |
| 5,343,963 | A | 9/1994 | Bouldin |
| 5,365,962 | A | 11/1994 | Taylor |
| 5,375,658 | A | 12/1994 | Schultz |
| 5,435,393 | A | 7/1995 | Brekke |
| 5,455,804 | A | 10/1995 | Holmes et al. |
| 5,464,059 | A | 11/1995 | Kristiansen |
| 5,482,117 | A | 1/1996 | Kolpak |
| 5,484,016 | A | 1/1996 | Surjaatmadja |
| 5,505,262 | A | 4/1996 | Cobb |
| 5,516,603 | A | 5/1996 | Holcombe |
| 5,533,571 | A | 7/1996 | Surjaatmadja |
| 5,547,029 | A | 8/1996 | Rubbo |
| 5,570,744 | A | 11/1996 | Weingarten |
| 5,578,209 | A | 11/1996 | Weiss |
| 5,673,751 | A | 10/1997 | Head |
| 5,707,214 | A * | 1/1998 | Schmidt ..... 417/109 |
| 5,730,223 | A | 3/1998 | Restarick |
| 5,803,179 | A | 9/1998 | Echols |
| 5,815,370 | A | 9/1998 | Sutton |
| 5,839,508 | A | 11/1998 | Tubel |
| 5,868,201 | A | 2/1999 | Bussear |
| 5,893,383 | A | 4/1999 | Facteau |
| 5,896,076 | A | 4/1999 | Van Namen |
| 5,896,928 | A | 4/1999 | Coon |
| 6,009,951 | A | 1/2000 | Coronado |
| 6,015,011 | A | 1/2000 | Hunter |
| 6,024,173 | A * | 2/2000 | Patel et al. ..... 166/374 |

(56) References Cited

U.S. PATENT DOCUMENTS 6,032,733 A 3/2000 Ludwig
6,059,040 A * 5/2000 Levitan et al. ..... 166/372
6,078,471 A 6/2000 Fiske
6,098,020 A 8/2000 DenBoer
6,109,370 A 8/2000 Gray
6,109,372 A 8/2000 Dorel et al.
6,112,817 A 9/2000 Voll
6,164,375 A 12/2000 Carisella
6,176,308 B1 1/2001 Pearson
6,179,052 B1 1/2001 Purkis
6,199,399 B1 3/2001 Voorhis
6,241,019 B1 6/2001 Davidson
6,247,536 B1 6/2001 Leismer
6,253,847 B1 7/2001 Stephenson
6,253,861 B1 7/2001 Carmichael
6,305,470 B1 10/2001 Woie
6,315,043 B1 11/2001 Farrant
6,315,049 B1 11/2001 Hickey
6,320,238 B1 11/2001 Kawabata
6,336,502 B1 1/2002 Surjaatmadja
6,345,963 B1 2/2002 Thomin
6,367,547 B1 4/2002 Towers
6,371,210 B1 4/2002 Bode
6,374,858 B1 4/2002 Hides
6,397,950 B1 6/2002 Streich
6,405,797 B2 6/2002 Davidson
6,426,917 B1 7/2002 Tabanou
6,431,282 B1 8/2002 Bosma
6,433,991 B1 8/2002 Deaton
6,450,263 B1 9/2002 Schwendemann
6,464,011 B2 10/2002 Tubel
6,470,970 B1 10/2002 Purkis
6,497,252 B1 12/2002 Kohler
6,505,682 B2 1/2003 Brockman
6,516,888 B1 2/2003 Gunnarson
6,540,263 B1 4/2003 Sausner
6,544,691 B1 4/2003 Guidotti
6,547,010 B2 4/2003 Hensley
6,567,013 B1 5/2003 Purkis
6,575,237 B2 6/2003 Purkis
6,575,248 B2 6/2003 Zhang
6,585,051 B2 7/2003 Purkis
6,619,394 B2 9/2003 Soliman
6,622,794 B2 9/2003 Zisk, Jr.
6,627,081 B1 9/2003 Hilditch
6,644,412 B2 11/2003 Bode
6,668,936 B2 12/2003 Williamson, Jr.
6,672,382 B2 1/2004 Schultz
6,679,324 B2 1/2004 Den Boer
6,679,332 B2 1/2004 Vinegar
6,691,781 B2 2/2004 Grant
6,695,067 B2 2/2004 Johnson
6,705,085 B1 3/2004 Braithwaite
6,708,763 B2 3/2004 Howard
6,719,048 B1 4/2004 Ramos
6,719,051 B2 4/2004 Hailey, Jr.
6,725,925 B2 4/2004 Al-Ramadhan
6,769,498 B2 8/2004 Hughes
6,786,285 B2 9/2004 Johnson
6,812,811 B2 11/2004 Robison
6,817,416 B2 11/2004 Wilson
6,834,725 B2 12/2004 Whanger
6,840,325 B2 1/2005 Stephenson
6,851,473 B2 2/2005 Davidson
6,851,560 B2 2/2005 Reig
6,857,475 B2 2/2005 Johnson
6,857,476 B2 2/2005 Richards
6,886,634 B2 5/2005 Richards
6,907,937 B2 6/2005 Whanger
6,913,079 B2 7/2005 Tubel
6,935,432 B2 8/2005 Nguyen
6,957,703 B2 10/2005 Trott
6,958,704 B2 10/2005 Vinegar
6,967,589 B1 11/2005 Peters
6,976,507 B1 12/2005 Webb
7,007,756 B2 3/2006 Lerche
7,011,101 B2 3/2006 Bowe
7,011,152 B2 3/2006 Soelvik
7,013,979 B2 3/2006 Richard
7,017,662 B2 3/2006 Schultz
7,025,134 B2 4/2006 Byrd
7,038,332 B2 5/2006 Robison
7,040,391 B2 5/2006 Leuthen
7,043,937 B2 5/2006 Lifson
7,059,401 B2 6/2006 Bode
7,063,162 B2 6/2006 Oaling
7,066,261 B2 6/2006 Vicente
7,096,945 B2 8/2006 Richards
7,100,686 B2 9/2006 Wittrisch
7,108,083 B2 9/2006 Simonds
7,114,560 B2 10/2006 Nguyen
7,143,832 B2 12/2006 Freyer
7,168,494 B2 1/2007 Starr
7,185,706 B2 3/2007 Freyer
7,199,480 B2 4/2007 Fripp
7,207,386 B2 4/2007 Brannon
7,213,650 B2 5/2007 Lehman
7,213,681 B2 5/2007 Birchak
7,216,738 B2 5/2007 Birchak
7,258,169 B2 8/2007 Fripp
7,290,606 B2 11/2007 Coronado
7,318,471 B2 1/2008 Rodney
7,322,409 B2 1/2008 Wittle
7,322,416 B2 1/2008 Burris
7,350,577 B2 4/2008 Howard
7,363,967 B2 4/2008 Burris
7,404,416 B2 7/2008 Schultz
7,405,998 B2 7/2008 Webb
7,409,999 B2 8/2008 Henriksen
7,413,010 B2 8/2008 Blauch
7,419,002 B2 9/2008 Oybevik
7,426,962 B2 9/2008 Moen
7,440,283 B1 10/2008 Rafie
7,455,104 B2 11/2008 Duhon
7,464,609 B2 12/2008 Fallet
7,468,890 B2 12/2008 Lin
7,469,743 B2 12/2008 Richards
7,520,321 B2 4/2009 Hiron
7,537,056 B2 5/2009 Macdougal
7,578,343 B2 8/2009 Augustine
7,621,336 B2 11/2009 Badalamenti
7,644,773 B2 1/2010 Richard
7,686,078 B2 3/2010 Khomynets
7,699,102 B2 4/2010 Storm
7,708,068 B2 5/2010 Hailey, Jr.
7,780,152 B2 8/2010 Rao
7,814,973 B2 10/2010 Dusterhoft
7,828,067 B2 11/2010 Scott
7,857,050 B2 12/2010 Zazovsky
7,882,894 B2 2/2011 Nguyen
7,918,272 B2 4/2011 Gaudette
8,016,030 B1 9/2011 Prado Garcia
8,025,103 B1 9/2011 Wolinsky
8,083,935 B2 12/2011 Eia
8,127,856 B1 3/2012 Nish
8,191,627 B2 6/2012 Hamid
8,196,665 B2 6/2012 Wolinsky
8,235,128 B2 8/2012 Dykstra
8,261,839 B2 9/2012 Fripp
8,272,443 B2 9/2012 Watson
8,276,669 B2 10/2012 Dykstra
8,302,696 B2 11/2012 Williams et al.
2002/0148607 A1 10/2002 Pabst
2002/0150483 A1 10/2002 Ursan
2003/0173086 A1 9/2003 Howard
2004/0011561 A1 1/2004 Hughes
2005/0110217 A1 5/2005 Wood
2005/0150657 A1 7/2005 Howard
2005/0173351 A1 8/2005 Neofotistos
2005/0214147 A1 9/2005 Schultz
2006/0076150 A1 4/2006 Coronado
2006/0113089 A1 6/2006 Henriksen
2006/0131033 A1 6/2006 Bode
2006/0185849 A1 8/2006 Edwards

(56) References Cited

U.S. PATENT DOCUMENTS

| | | | | |
|---|---|---|---|---|
| 2007/0012454 | A1 | 1/2007 | Ross | |
| 2007/0028977 | A1 | 2/2007 | Goulet | |
| 2007/0045038 | A1 | 3/2007 | Han | |
| 2007/0107719 | A1 | 5/2007 | Blacker | |
| 2007/0169942 | A1 | 7/2007 | Loretz | |
| 2007/0173397 | A1 | 7/2007 | Hinman | |
| 2007/0193752 | A1 | 8/2007 | Kim | |
| 2007/0246225 | A1 | 10/2007 | Hailey | |
| 2007/0246407 | A1 | 10/2007 | Richards | |
| 2007/0256828 | A1 | 11/2007 | Birchak | |
| 2008/0035330 | A1 | 2/2008 | Richards | |
| 2008/0041580 | A1 | 2/2008 | Freyer | |
| 2008/0041581 | A1 | 2/2008 | Richards | |
| 2008/0041582 | A1 | 2/2008 | Saetre | |
| 2008/0041588 | A1 | 2/2008 | Richards | |
| 2008/0149323 | A1 | 6/2008 | Omalley | |
| 2008/0169099 | A1 | 7/2008 | Pensgaard | |
| 2008/0236839 | A1 | 10/2008 | Oddie | |
| 2008/0251255 | A1 | 10/2008 | Forbes | |
| 2008/0261295 | A1 | 10/2008 | Butler | |
| 2008/0283238 | A1 | 11/2008 | Richards | |
| 2008/0314578 | A1 | 12/2008 | Jackson | |
| 2008/0314590 | A1 | 12/2008 | Patel | |
| 2009/0000787 | A1 | 1/2009 | Hill | |
| 2009/0008088 | A1 | 1/2009 | Schultz | |
| 2009/0008090 | A1 | 1/2009 | Schultz et al. | |
| 2009/0009297 | A1 | 1/2009 | Shinohara et al. | |
| 2009/0009333 | A1 | 1/2009 | Bhogal et al. | |
| 2009/0009336 | A1 | 1/2009 | Ishikawa | |
| 2009/0009412 | A1 | 1/2009 | Warther | |
| 2009/0009437 | A1 | 1/2009 | Hwang et al. | |
| 2009/0009445 | A1 | 1/2009 | Lee | |
| 2009/0009447 | A1 | 1/2009 | Naka et al. | |
| 2009/0020292 | A1 | 1/2009 | Loretz | |
| 2009/0065197 | A1 | 3/2009 | Eslinger | |
| 2009/0078427 | A1 | 3/2009 | Patel | |
| 2009/0078428 | A1 | 3/2009 | Ali | |
| 2009/0101342 | A1 | 4/2009 | Gaudette | |
| 2009/0101344 | A1 | 4/2009 | Crow | |
| 2009/0101352 | A1 | 4/2009 | Coronado | |
| 2009/0101354 | A1 | 4/2009 | Holmes | |
| 2009/0114395 | A1 | 5/2009 | Holmes | |
| 2009/0120647 | A1 | 5/2009 | Turick | |
| 2009/0133869 | A1 | 5/2009 | Clem | |
| 2009/0145609 | A1 | 6/2009 | Holmes et al. | |
| 2009/0151925 | A1 | 6/2009 | Richards | |
| 2009/0159282 | A1 | 6/2009 | Webb | |
| 2009/0188661 | A1 | 7/2009 | Bizon | |
| 2009/0205831 | A1 | 8/2009 | Jacob | |
| 2009/0226301 | A1 | 9/2009 | Priestman et al. | |
| 2009/0236102 | A1 | 9/2009 | Guest et al. | |
| 2009/0250224 | A1 | 10/2009 | Wright et al. | |
| 2009/0277639 | A1 | 11/2009 | Schultz | |
| 2009/0277650 | A1 | 11/2009 | Casciaro | |
| 2009/0301730 | A1 | 12/2009 | Gweily | |
| 2010/0025045 | A1 | 2/2010 | Lake | |
| 2010/0122804 | A1 | 5/2010 | Yang | |
| 2010/0181251 | A1 | 7/2010 | Alspektor | |
| 2010/0249723 | A1 | 9/2010 | Fangrow, Jr. | |
| 2010/0300568 | A1 | 12/2010 | Faram | |
| 2011/0017458 | A1 | 1/2011 | East | |
| 2011/0042091 | A1 | 2/2011 | Dykstra | |
| 2011/0042092 | A1 | 2/2011 | Fripp et al. | |
| 2011/0042323 | A1 | 2/2011 | Sullivan | |
| 2011/0079384 | A1 | 4/2011 | Russell | |
| 2011/0139451 | A1 | 6/2011 | McKeen | |
| 2011/0139453 | A1* | 6/2011 | Schultz et al. | 166/272.3 |
| 2011/0158832 | A1 | 6/2011 | Wang et al. | |
| 2011/0186300 | A1 | 8/2011 | Dykstra et al. | |
| 2011/0198097 | A1 | 8/2011 | Moen | |
| 2011/0203671 | A1 | 8/2011 | Doig | |
| 2011/0214876 | A1 | 9/2011 | Dykstra | |
| 2011/0266001 | A1 | 11/2011 | Dykstra | |
| 2011/0297384 | A1 | 12/2011 | Fripp | |
| 2011/0297385 | A1 | 12/2011 | Dykstra | |
| 2012/0048563 | A1 | 3/2012 | Holderman | |
| 2012/0060624 | A1 | 3/2012 | Dykstra | |
| 2012/0061088 | A1 | 3/2012 | Dykstra | |
| 2012/0111577 | A1 | 5/2012 | Dykstra | |
| 2012/0125120 | A1 | 5/2012 | Dykstra | |
| 2012/0125626 | A1 | 5/2012 | Constantine | |
| 2012/0138304 | A1 | 6/2012 | Dykstra | |
| 2012/0145385 | A1 | 6/2012 | Lopez | |
| 2012/0152527 | A1 | 6/2012 | Dykstra | |
| 2012/0167994 | A1* | 7/2012 | Schultz et al. | 137/12 |
| 2012/0181037 | A1 | 7/2012 | Holderman | |
| 2012/0211243 | A1 | 8/2012 | Dykstra | |
| 2012/0234557 | A1 | 9/2012 | Dykstra | |
| 2012/0255351 | A1 | 10/2012 | Dykstra | |
| 2012/0255739 | A1 | 10/2012 | Fripp | |
| 2012/0255740 | A1 | 10/2012 | Fripp | |
| 2012/0273297 | A1* | 11/2012 | Schlosser | 181/213 |
| 2012/0305243 | A1 | 12/2012 | Hallundbaek et al. | |
| 2013/0020088 | A1 | 1/2013 | Dyer et al. | |
| 2013/0075107 | A1 | 3/2013 | Dykstra | |

FOREIGN PATENT DOCUMENTS

| | | | |
|---|---|---|---|
| EP | 1857633 | | 11/2007 |
| EP | 1857633 | A2 | 11/2007 |
| WO | 0063530 | A1 | 10/2000 |
| WO | 0214647 | A2 | 2/2002 |
| WO | 03062597 | A1 | 7/2003 |
| WO | 2004012040 | A2 | 2/2004 |
| WO | 2004081335 | A2 | 9/2004 |
| WO | 2006015277 | A1 | 2/2006 |
| WO | 2008024645 | A2 | 2/2008 |
| WO | PCT/US08/075668 | | 9/2008 |
| WO | 2009081088 | A2 | 2/2009 |
| WO | 2009052076 | A2 | 4/2009 |
| WO | 2009052103 | A2 | 4/2009 |
| WO | 2009052149 | | 4/2009 |
| WO | PCT/US09/046363 | | 6/2009 |
| WO | PCT/US09/046404 | | 6/2009 |
| WO | 2009088292 | A1 | 7/2009 |
| WO | 2009088293 | A1 | 7/2009 |
| WO | 2009088624 | A2 | 7/2009 |
| WO | 2011002615 | A2 | 1/2011 |

OTHER PUBLICATIONS

"Fluidics", Microsoft Encarta Online Encylopedia, copyright 1997-2009.

Kirshner et al., "Design Theory of Fluidic Components", 1975, Academic Press, New York.

Kirshner, "Fluid Amplifiers", 1966, McGraw-Hill, New York.

Tesar, "New Ways of Fluid Flow Control in Automobiles: Experience with Exhaust Gas Aftertreatment Control", Seoul 2000 FISITA World Automotive Congress, Jun. 12-15, 2000, F2000H192.

Tesar, "Sampling by Fluidics and Microfluidics", Acta Polytechnica vol. 42 No. Feb. 2002, Jun. 24, 2005.

Angrist, "Fluid Control Device", Scientific American Dec. 1964, pp. 80-88, Dec. 1, 1964.

Freyer, "An Oil Selective Inflow Control System", SPE 78272, Oct. 2002.

Flossert "Constant Flow Rate Product Brochure", Dec. 2002, 1 page.

Savkar, An Experimental Study of Switching in a Bistable Fluid Amplifier, University of Michigan, Dec. 1966.

"Apparatus and Method of Inducting Fluidic Oscillation in a Rotating Cleaning Nozzle," ip.com, dated Apr. 24, 2007, 3 pages.

Stephen L. Crow, Martin P. Coronado, Rustom K. Mody, "Means for Passive Inflow Control Upon Gas Breakthrough," SPE 102208, 2006 SPE Annual Technical Conference and Exhibition, San Antonio, Texas, U.S.A., Sep. 24-27, 2006, 6 pages.

Gebben, Vernon D., "Vortex Valve Performance Power Index," NASA TM X-52257, May 1967, pp. 1-14 plus 2 cover pages and Figures 1-8, National Aeronautics and Space Administration.

Haakh, Dr.-Ing. Frieder, "Vortex Chamber Diodes as Throttle Devices in Pipe Systems. Computation of Transient Flow," Journal of Hydraulic Research, 2003, vol. 41, No. 1, pp. 53-59.

(56) References Cited

OTHER PUBLICATIONS

Holmes, Allen B., et al., "A fluidic approach to the design of a mud pulser for bore-hole telemetry while drilling," DRCMS Code: 7-36AA-7100, HDL Project: A54735, Aug. 1979, pp. 1,2,5,6,9-27, and 29-37, Department of the Interior, U.S. Geological Survey, Washington, D.C.
Lee Precision Micro Hydraulics, Lee Restrictor Selector product brochure; Jan. 2011, 9 pages.
The Lee Company Technical Center, "Technical Hydraulic Handbook," 11th Edition, copyright 1971-2009, 7 pages Connecticut.
Weatherford product brochure entitled, "Application Answers—Combating Coning by Creating Even Flow Distribution in Horizontal Sand-Control Completions," 2005, 4 pages, Weatherford.
J.D Willingham, H.C. Tan, L.R. Norman, "Perforation Friction Pressure of Fracturing Fluid Slurries," SPE 25891, SPE Rocky Mountain Regional/Low Permeability Reservoirs Symposium, Denver, Co., U.S.A., Apr. 12-14, 1993, 14 pages.
Masahiro Takebayashi, Hiroshi Iwata, Akio Sakazume, Hiroaki Hata, "Discharge Characteristics of an Oil Feeder Pump Using Nozzle Type Fluidic Diodes for a Horizontal Compressor Depending on the Driving Speed," International Compressor Engineering Conference, Paper 597, 1988, 9 pages.
Canadian Office Action, Application No. 2,737,998, dated Jun. 21, 2013, 3 pages.
International Search Report and Written Opinion, Application No. PCT/US2012/032044, dated Oct. 29, 2012, 9 pages.
Tesar, V., *Fluidic Valve for Reactor Regeneration Flow Switching*, Chemical Engineering Research and Design, Mar. 2004, pp. 398-408, vol. 82, No. A3, Institution of Chemical Engineers.
Tesar, V., *Fluidic Valves for Variable-Configuration Gas Treatment*, Chemical Engineering Research and Design, Sep. 2005, pp. 1111-1121, vol. 83, No. A9, Institution of Chemical Engineers.
Singaporean Written Opinion, Application No. 2014008791, dated Sep. 4, 2015, 6 pages.

* cited by examiner

AUTONOMOUS FLUID CONTROL SYSTEM HAVING A FLUID DIODE

FIELD OF INVENTION

The invention relates to apparatus and methods for autonomously controlling fluid flow through a system using a fluid diode. More specifically, the invention relates to using a fluid diode defined by an orifice having a high resistance side and a low resistance side.

BACKGROUND OF INVENTION

Some wellbore servicing tools provide a plurality of fluid flow paths between the interior of the wellbore servicing tool and the wellbore. However, fluid transfer through such a plurality of fluid flow paths may occur in an undesirable and/or non-homogeneous manner. The variation in fluid transfer through the plurality of fluid flow paths may be attributable to variances in the fluid conditions of an associated hydrocarbon formation and/or may be attributable to operational conditions of the wellbore servicing tool, such as a fluid flow path being unintentionally restricted by particulate matter.

SUMMARY OF THE INVENTION

The invention provides apparatus and methods for autonomously controlling fluid flow in a subterranean well, and in particular for providing a fluid diode to create a relatively high resistance to fluid flow in one direction and a relatively low resistance to fluid flowing in the opposite direction. The diode is positioned in a fluid passageway and has opposing high resistance and low resistance entries. The low resistance entry providing a relatively low resistance to fluid flowing into the diode through the low resistance entry. The high resistance entry providing a relatively high resistance to fluid flowing into the diode through the high resistance entry. In a preferred embodiment, the high resistance entry has a concave, annular surface surrounding an orifice and the low resistance entry has a substantially conical surface. The entries can have a common orifice. In one embodiment, the concave, annular surface of the high resistance entry extends longitudinally beyond the plane of the orifice. That is, a portion of a fluid flowing through the diode from the high resistance side will flow longitudinally past, but not through, the orifice, before being turned by the concave, annular surface. In a preferred embodiment, the fluid will flow in eddies adjacent the concave, annular surface.

The apparatus and method can be used in conjunction with other autonomous flow control systems, including those having flow control assemblies and vortex assemblies. The invention can be used in production, injection and other servicing operations of a subterranean wellbore. The invention can be positioned to provide relatively higher resistance to fluid flow as it moves towards or away from the surface.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. "Uphole," "downhole" are used to indicate location or direction in relation to the surface, where uphole indicates relative position or movement towards the surface along the wellbore and downhole indicates relative position or movement further away from the surface along the wellbore, regardless of the wellbore orientation (unless otherwise made clear).

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

Figure 1:
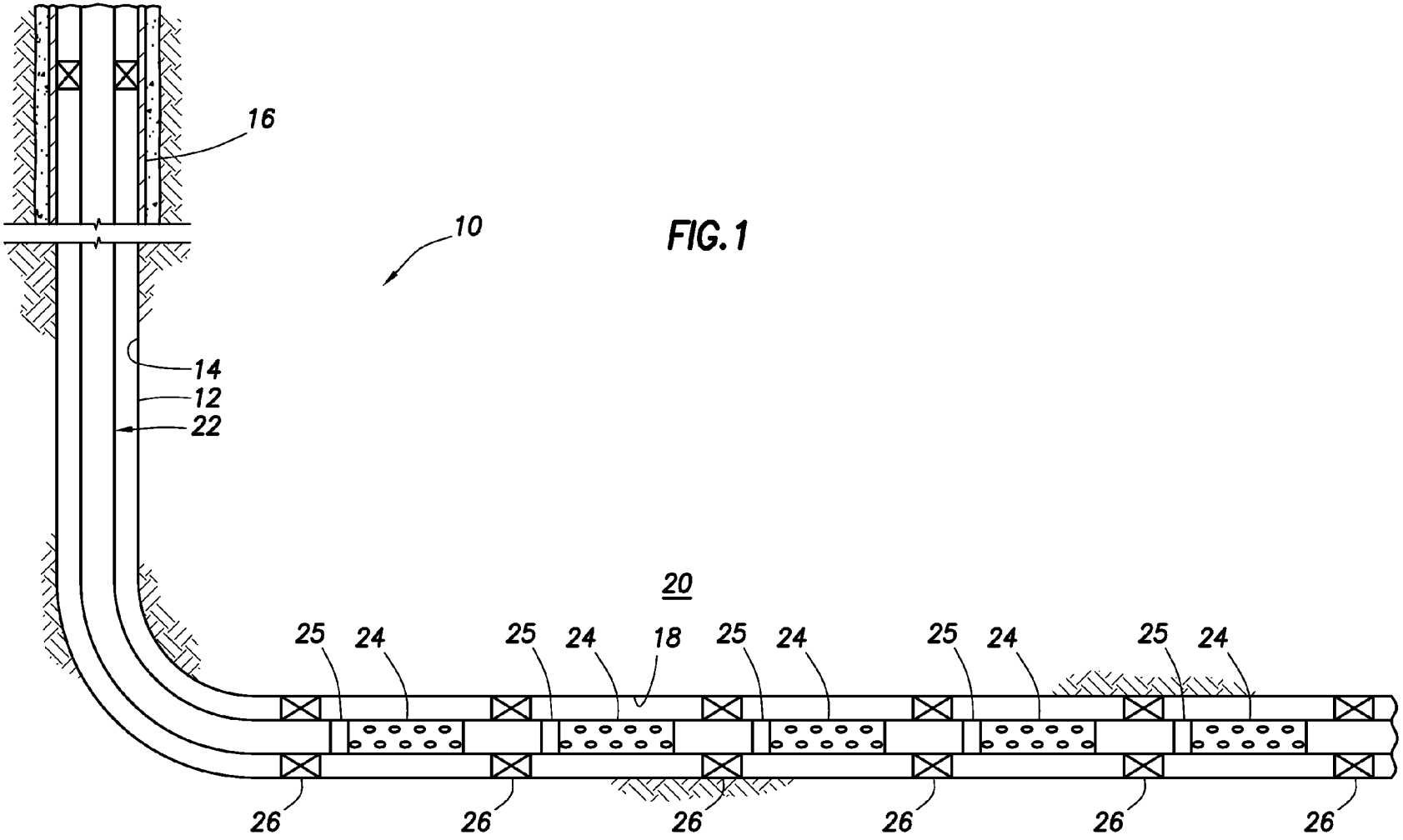
FIG. 1 is a schematic illustration of a well system including a plurality of autonomous fluid flow control systems according to an embodiment of the invention.

FIG. 1 is a schematic illustration of a well system, indicated generally 10, including a plurality of autonomous flow control systems embodying principles of the present invention. A wellbore 12 extends through various earth strata. Wellbore 12 has a substantially vertical section 14, the upper portion of which has installed therein a casing string 16. Wellbore 12 also has a substantially deviated section 18, shown as horizontal, which extends through a hydrocarbon-bearing subterranean formation 20. As illustrated, substantially horizontal section 18 of wellbore 12 is open hole. While shown here in an open hole, horizontal section of a wellbore, the invention will work in any orientation, and in open or cased hole. The invention will also work equally well with injection systems.

Positioned within wellbore 12 and extending from the surface is a tubing string 22. Tubing string 22 provides a conduit for fluids to travel from formation 20 upstream to the surface. Positioned within tubing string 22 in the various production intervals adjacent to formation 20 are a plurality of autonomous fluid control systems 25 and a plurality of production tubing sections 24. At either end of each production tubing section 24 is a packer 26 that provides a fluid seal between tubing string 22 and the wall of wellbore 12. The space in-between each pair of adjacent packers 26 defines a production interval.

In the illustrated embodiment, each of the production tubing sections 24 includes sand control capability. Sand control screen elements or filter media associated with production tubing sections 24 are designed to allow fluids to flow therethrough but prevent particulate matter of sufficient size from flowing therethrough.

The fluid flowing into the production tubing section typically comprises more than one fluid component. Typical components are natural gas, oil, water, steam or carbon dioxide. Steam and carbon dioxide are commonly used as injection fluids to drive the hydrocarbon towards the production tubular, whereas natural gas, oil and water are typically found in situ in the formation.

The invention provides a method and apparatus for use of a fluid diode in a passageway to provide a relatively high resistance to fluid flow through a passageway in one direction while providing a relatively low resistance to fluid flow in the opposite direction. It is envisioned that such relative restriction of fluid flow can be used in any operation where fluid flow is desired in one direction and undesired in the opposite direction. For example, during production of hydrocarbons from the wellbore, fluid typically flows from the wellbore, into the tubing string, and thence uphole towards the surface. However, if flow is reversed for some reason, a fluid diode, or series of diodes, will restrict flow in the reverse direction. The diodes can be used similarly in injection operations to restrict fluid flow uphole. Persons of skill in the art will recognize other uses where restriction of flow in one direction is preferable.

Figure 2:
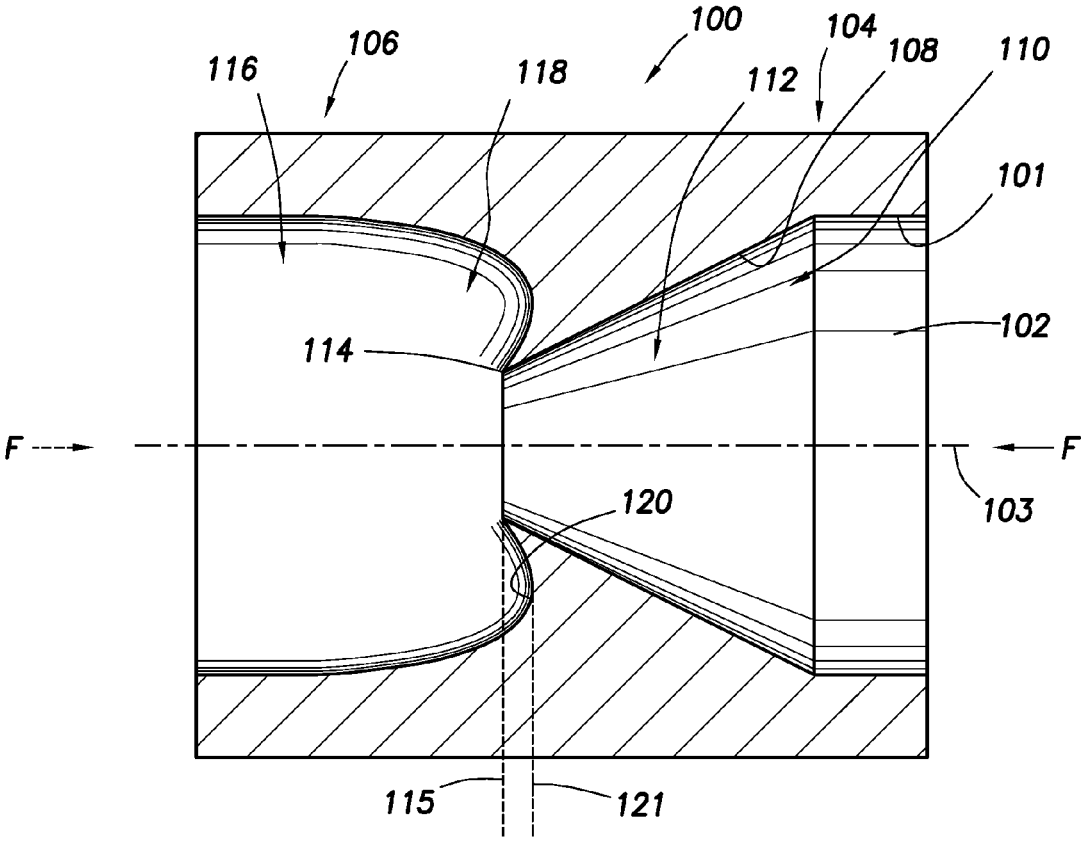
FIG. 2 is a cross-sectional view of a fluid diode of a preferred embodiment of the invention.

FIG. 2 is a cross-sectional view of a fluid diode of a preferred embodiment of the invention. The fluid diode 100 is positioned in a fluid passageway 102 defined by a passageway wall 101. The passageway 102 can be positioned in a downhole tool, tubing string, as part of a larger autonomous fluid control system, in series with additional fluid diodes, or individually.

The fluid diode 100 has a low resistance entry 104 and a high resistance entry 106. The low resistance entry 104, in the preferred embodiment shown, has a substantially conical surface 108 narrowing from a large diameter end 110 to a small diameter end 112 and terminating at an orifice 114. The substantially conical surface is preferably manufactured such that it is, in fact, conical; however, the surface can instead vary from truly conical, such as made of a plurality of flat surfaces arranged to provide a cone-like narrowing. The high resistance entry 106 narrows from a large diameter end 116 to a small diameter end 118 and terminates at an orifice 114. In the preferred embodiment shown, the orifice 114 for the high and low resistance ends is coincident. In other embodiments, the orifices can be separate. The orifice 114, high resistance entry 106 and low resistance entry 104 are preferably centered on the longitudinal axis 103 of the passageway 102. The orifice 114 lies in a plane 115. Preferably the plane 115 is normal to the longitudinal axis 103.

The high resistance entry 106 preferably includes a concave surface 120. The concave surface 120 is annular, extending around the orifice 114. In a preferred embodiment, as seen in FIG. 2, the concave surface 120 curves along an arc through more than 90 degrees. Here, "arc" does not require that the surface be a segment of a circle; the surface seen in FIG. 2 is not circular, for example. The concave surface can be a segment of a circle, ellipse, etc., or irregular. The concave surface extends longitudinally from one side of the plane 115 of the orifice 114 to another. For purposes of discussion, the concave surface 120 extends longitudinally from a point upstream of the plane of the orifice (when fluid is flowing into the high resistance entry 106) to a furthest extent downstream from the place of the orifice. That is, the concave surface extends longitudinally beyond the plane of the orifice. The furthest extent downstream of the concave surface 120 is indicated by dashed line 121. In the embodiment shown, the longitudinal extent of the conical surface 108 overlaps with the longitudinal extent of the concave surface 120.

In use, fluid F can flow either direction through the diode 100. When fluid flows into the diode through the low resistance entry 104, as indicated by the solid arrow in FIG. 2, the diode provides a lower resistance to fluid flow than when fluid flows into the diode through the high resistance entry 106, as indicated by the dashed arrow in FIG. 2. In a typical use, fluid flow in the low resistance direction is preferred, such as for production of well fluid. If flow is reversed, such that it flows through the diode from the high resistance entry, flow is restricted.

Figure 3:
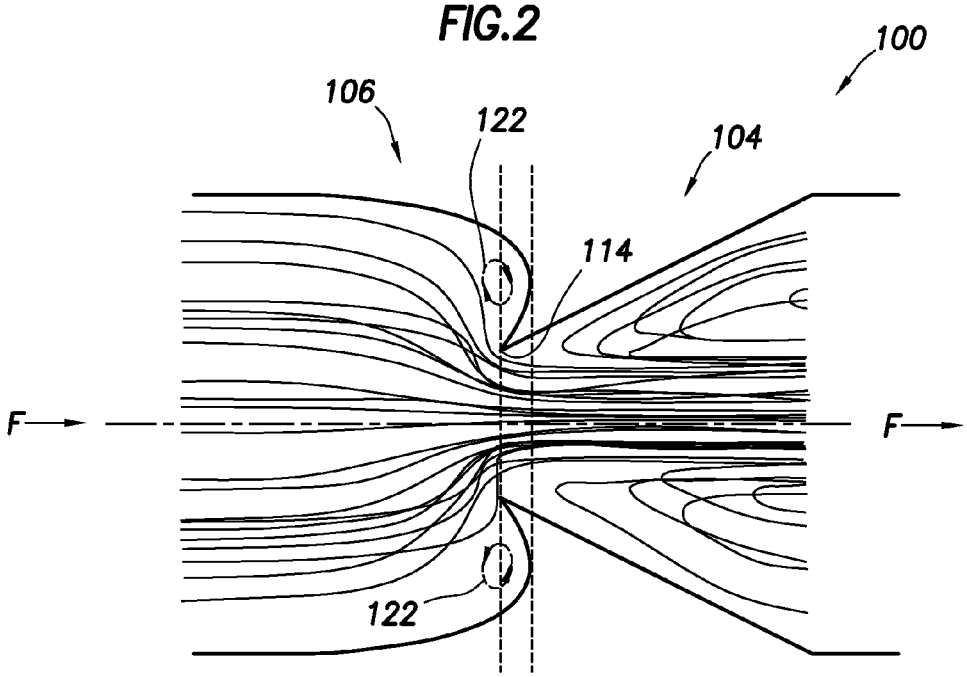
FIG. 3 is a flow diagram representative of a fluid flowing into the fluid diode through the high resistance entry.
Figure 4:
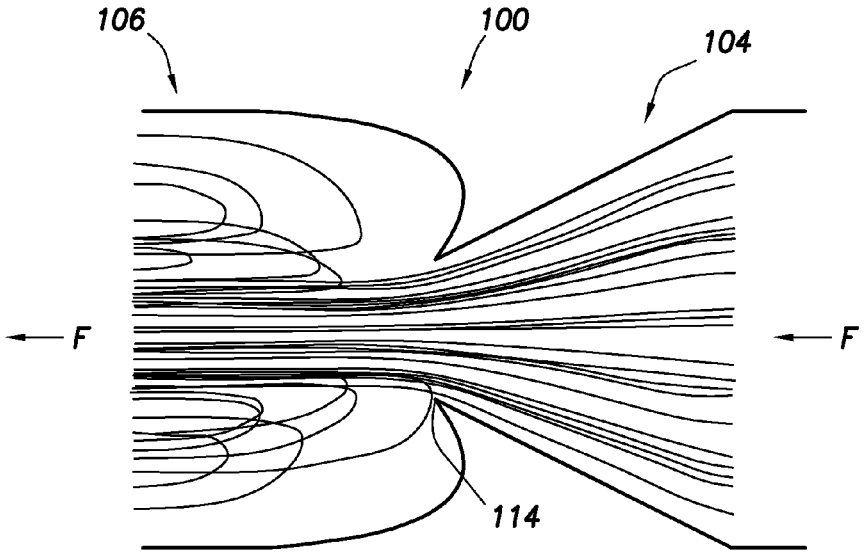
FIG. 4 is a flow diagram representative of a fluid flowing into the fluid diode through the low resistance entry.

FIG. 3 is a flow diagram representative of a fluid F flowing into the fluid diode 100 through the high resistance entry 106. FIG. 4 is a flow diagram representative of a fluid F flowing into the diode 100 through the low resistance entry 104. The flow lines shown are velocity flow lines. Where fluid enters from the high resistance side, as in FIG. 3, a portion of the fluid flow is directed substantially radially, toward the axis 103. The fluid flow through the orifice 114 is substantially restricted or slowed, and total fluid flow across the diode is similarly restricted. The pressure drop across the diode is correspondingly relatively higher. In a preferred embodiment, eddies 122 are created adjacent the concave surface of the high resistance entry. Where fluid enters the diode from the low resistance side, as in FIG. 4, fluid flows through the diode with relatively lower resistance, with a corresponding lower pressure drop across the diode.

The following data is exemplary in nature and generated from computer modeling of a diode similar to that in FIG. 2-4. The pressure drops across the diode and resistance to fluid flow is dependent on the direction of fluid flow through the diode. Water at a flow rate of 0.2 kg per second experienced a pressure drop across the diode of approximately 4200 Pa when flowing into the diode from the high resistance side. Water flowing the opposite direction, from the low resistance side, only experienced a pressure drop of approximately 2005 Pa. Similarly, air having a density of 1.3 kg per cubic meter and at the same flow rate, experienced a pressure drop of 400 psi when flowing in the restricted direction and only a 218 psi pressure drop in the unrestricted direction. Finally, gas modeled at 150 kg per cubic meter and at the same flow rate, experienced a pressure drop of 5 psi in the restricted direction and 2 psi in the unrestricted direction. These data points are exemplary only.

Figure 5C:
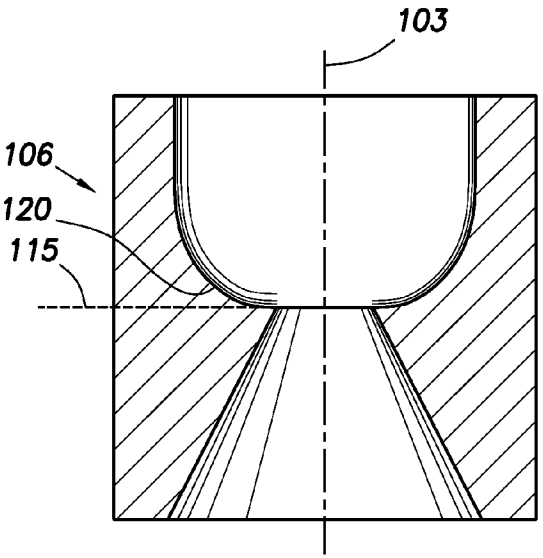
FIGS. 5A-C are exemplary embodiments of fluid diodes according to the invention.
Figure 5B:
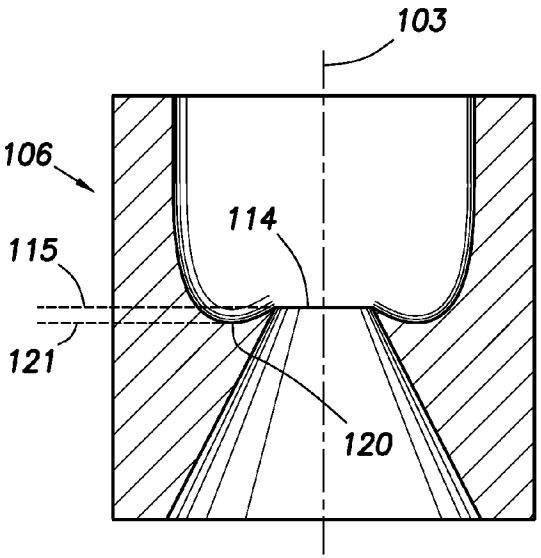
Figure 5A:
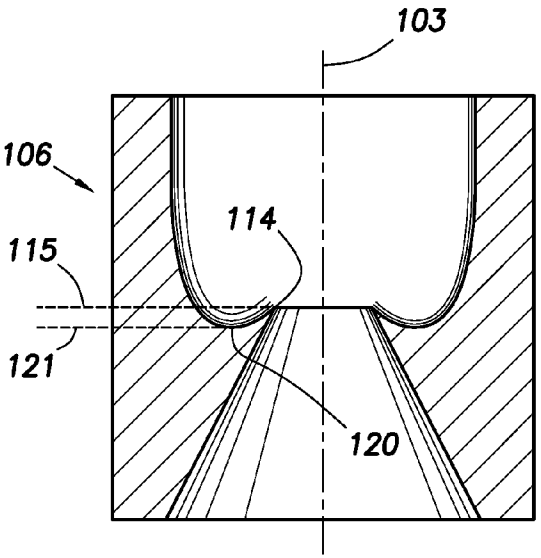

FIGS. 5A-C are exemplary embodiments of fluid diodes according to the invention. FIGS. 5A-C show alternate profiles for the concave, annular surface 120 of the fluid diode 100. In FIG. 5A, the profile is similar to that in FIG. 2, wherein the concave surface 120 curves through more than 90 degrees, has a comparatively deep "pocket," and extends to a point at 121 past the plane 115 of the orifice 114. FIG. 5B is similar, however, the concave surface 120 is shallower. In FIG. 5C the concave surface 120 curves through 90 degrees and does not extend longitudinally past the orifice plane 115. The design of FIG. 5A is presently preferred and provides the greatest pressure drop when flow is in the restricted direction. Using modeling techniques, the pressure drops across the diodes in FIGS. 5A-C were 4200 Pa, 3980 Pa and 3208 Pa, respectively. Additionally, the high resistance entry can take other shapes, such as curved surfaces having additional curvatures to the concave surface shown, concave surfaces which vary from the exact curvature shown, a plurality of flat surfaces which provide a substantially similar concave surface when taken in the aggregate, or even having a rectangular cross-section. Further, the passageway can have round, rectangular, or other cross-sectional shape.

Figure 6:
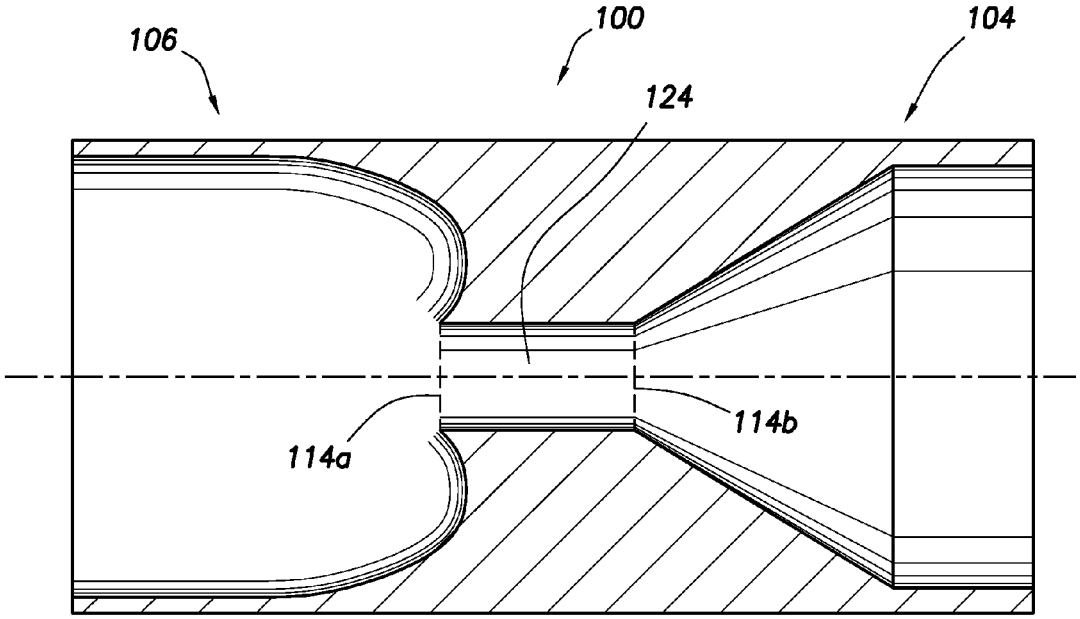
FIG. 6 is a cross-sectional view of an alternate embodiment of a fluid diode according to an aspect of the invention.

FIG. 6 is a cross-sectional view of an alternate embodiment of a fluid diode according to an aspect of the invention. FIG. 6 shows an alternate embodiment wherein the orifice 114*a* of the high resistance entry 106 is not coincident with the orifice 114*b* of the low resistance entry 104. A relatively narrow conduit 124 connects the orifices.

Figure 7:
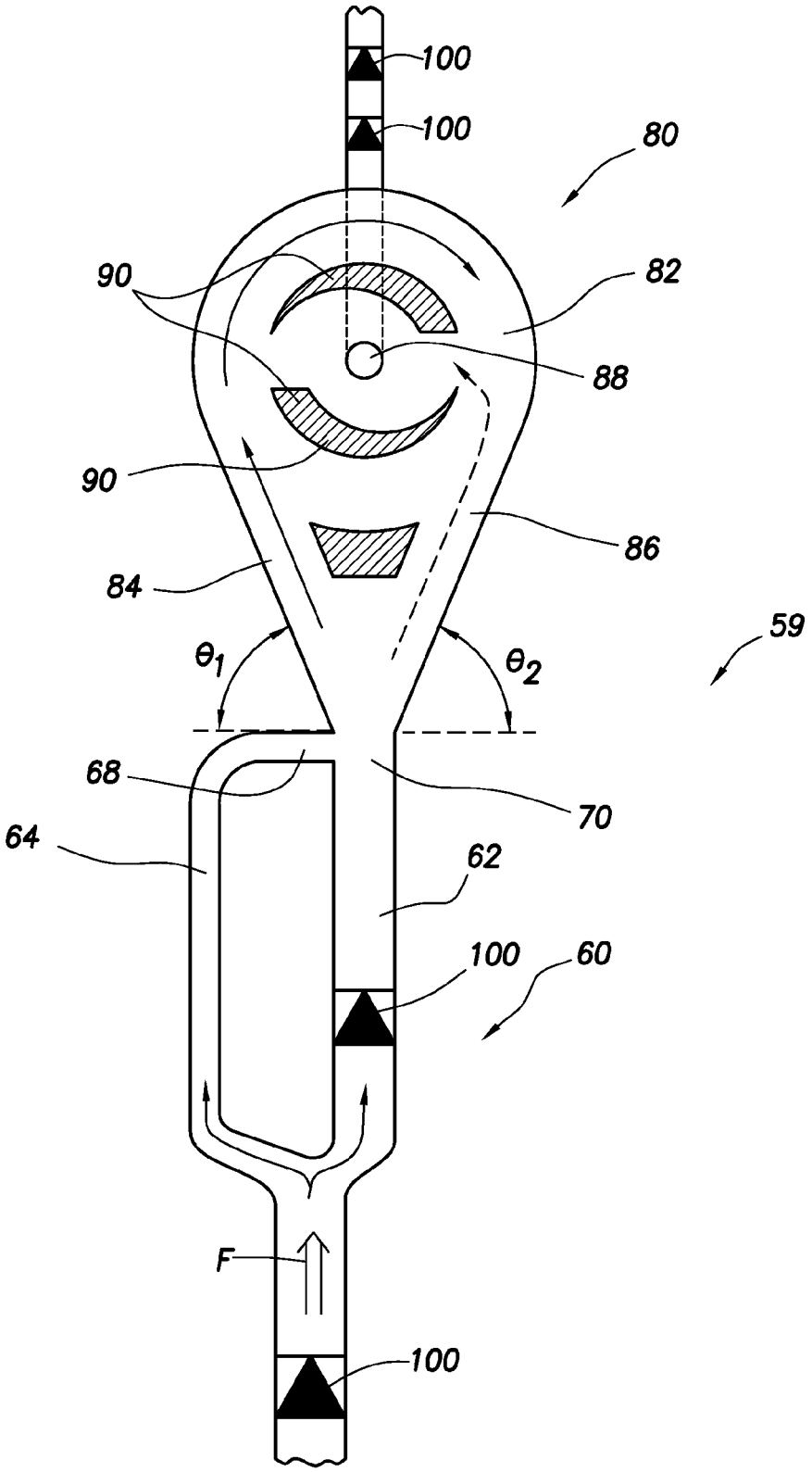
FIG. 7 is a schematic diagram of an exemplary fluid control system 59 having a fluid diode according to aspects of the invention.

FIG. 7 is a schematic diagram of an exemplary fluid control system 59 having a fluid diode according to aspects of the invention. The fluid control system 59 is explained in detail in references which are incorporated herein by reference and will not be described in detail here. The fluid control system is designed for fluid flow in the direction indicated by the double arrows, F. Fluid, such as production fluid, enters the fluid control system 59, flows through the passageways 62 and 64 of the flow control assembly 60, exits through outlets 68 and 70. Fluid then flows into the vortex assembly 80 through an inlet 84 or 86, by optional directional elements 90, through vortex chamber 82 and out of the vortex outlet 88. Fluid then flows downstream (which in this embodiment is uphole), such as to the surface. While flow in this direction is preferred and typical, the fluid diode of the invention can be used in conjunction with or as part of the flow control system to restrict or prevent reverse fluid flow through the system. As indicated, one or more fluid diodes 100 can be employed at locations along the system, upstream or downstream from the system.

In a preferred embodiment, fluid diodes 100 are arranged in series, such that the fluid flow passes through a plurality of diodes. For example, two diodes 100 are seen downstream of the vortex assembly 80 in FIG. 7. As discussed above, when fluid flows through the high resistance side of the diode, a greater pressure drop is realized across the diode than when flow is in the opposite direction. However, the pressure drop across a plurality of diodes will be greater still. It is preferred that a plurality of diodes in series be used to create a much greater total pressure drop across the plurality of diodes. In such a manner, the reverse flow through the system can be substantially restricted.

The diode explained herein can be used in conjunction with the various flow control systems, assemblies and devices described in the incorporated references as will be understood by those of skill in the art.

Descriptions of fluid flow control using autonomous flow control devices and their application can be found in the following U.S. Patents and Patent Applications, each of which are hereby incorporated herein in their entirety for all purposes: U.S. patent application Ser. No. 12/635,612, entitled "Fluid Flow Control Device," to Schultz, filed Dec. 10, 2009; U.S. patent application Ser. No. 12/770,568, entitled "Method and Apparatus for Controlling Fluid Flow Using Movable Flow Diverter Assembly," to Dykstra, filed Apr. 29, 2010; U.S. patent application Ser. No. 12/700,685, entitled "Method and Apparatus for Autonomous Downhole Fluid Selection With Pathway Dependent Resistance System," to Dykstra, filed Feb. 4, 2010; U.S. patent application Ser. No. 12/791,993, entitled "Flow Path Control Based on Fluid Characteristics to Thereby Variably Resist Flow in a Subterranean Well," to Dykstra, filed Jun. 2, 2010; U.S. patent application Ser. No. 12/792,095, entitled "Alternating Flow Resistance Increases and Decreases for Propagating Pressure Pulses in a Subterranean Well," to Fripp, filed Jun. 2, 2010; U.S. patent application Ser. No. 12/792,117, entitled "Variable Flow Resistance System for Use in a Subterranean Well," to Fripp, filed Jun. 2, 2010; U.S. patent application Ser. No. 12/792,146, entitled "Variable Flow Resistance System With Circulation Inducing Structure Therein to Variably Resist Flow in a Subterranean Well," to Dykstra, filed Jun. 2, 2010; U.S. patent application Ser. No. 12/879,846, entitled "Series Configured Variable Flow Restrictors For Use In A Subterranean Well," to Dykstra, filed Sep. 10, 2010; U.S. patent application Ser. No. 12/869,836, entitled "Variable Flow Restrictor For Use In A Subterranean Well," to Holderman, filed Aug. 27, 2010; U.S. patent application Ser. No. 12/958,625, entitled "A Device For Directing The Flow Of A Fluid Using A Pressure Switch," to Dykstra, filed Dec. 2, 2010; U.S. patent application Ser. No. 12/974,212, entitled "An Exit Assembly With a Fluid Director for Inducing and Impeding Rotational Flow of a Fluid," to Dykstra, filed Dec. 21, 2010; U.S. patent application Ser. No. 12/983,144, entitled "Cross-Flow Fluidic Oscillators for use with a Subterranean Well," to Schultz, filed Dec. 31, 2010; U.S. patent application Ser. No. 12/966,772, entitled "Downhole Fluid Flow Control System and Method Having Direction Dependent Flow Resistance," to Jean-Marc Lopez, filed Dec. 13, 2010; U.S. patent application Ser. No. 12/983,153, entitled "Fluidic Oscillators For Use With A Subterranean Well (includes vortex)," to Schultz, filed Dec. 31, 2010; U.S. patent application Ser. No. 13/084,025, entitled "Active Control for the Autonomous Valve," to Fripp, filed Apr. 11, 2011; U.S. Patent Application Ser. No. 61/473,700, entitled "Moving Fluid Selectors for the Autonomous Valve," to Fripp, filed Apr. 8, 2011; U.S. Patent Application Ser. No. 61/473,699, entitled "Sticky Switch for the Autonomous Valve," to Fripp, filed Apr. 8, 2011; and U.S. patent application Ser. No. 13/100,006, entitled "Centrifugal Fluid Separator," to Fripp, filed May 3, 2011.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

The invention claimed is:

1. An apparatus for autonomously controlling fluid flow in a subterranean well, the apparatus comprising:

a fluid passageway having a fluid diode positioned therein;

the fluid diode having opposing high resistance and low resistance entries through which fluid may enter or exit the fluid diode; the low resistance entry providing a relatively low resistance to fluid flowing into the diode through the low resistance entry; and the high resistance entry providing a relatively high resistance to fluid flowing into the diode through the high resistance entry, and wherein the high resistance entry has a concave, annular surface surrounding an orifice, wherein the fluid passageway is one of a pair of parallel passageways that extend between a common inlet where fluid may be divided into the pair of parallel passageways and respective outlets where fluid may be recombined from the pair of parallel passageways.

2. An apparatus as in claim 1, wherein the low resistance entry has a substantially conical surface.

3. An apparatus as in claim 2, wherein the substantially conical surface narrows and ends at the orifice.

4. An apparatus as in claim 1, wherein the concave annular surface extends longitudinally beyond the plane of the orifice.

5. An apparatus as in claim 1, further comprising a downhole tool, the fluid passageway and diode positioned in the downhole tool.

6. An apparatus as in claim 5, wherein the subterranean well extends from the surface, and wherein the diode is positioned such that fluid flow towards the surface enters the low resistance entry of the diode.

7. An apparatus as in claim 5, further comprising an autonomous fluid control system having a vortex assembly and flow control assembly.

8. An apparatus as in claim 7, wherein the diode is positioned upstream from the vortex assembly.

9. An apparatus as in claim 7, wherein the diode is positioned downstream from the flow control assembly.

10. An apparatus as in claim 4, the concave surface for creating eddies in fluid flowing into the diode through the high-resistance entry.

11. A method of servicing a wellbore extending through a hydrocarbon-bearing subterranean formation, the method comprising the steps of:

providing a fluid diode in fluid communication with the wellbore;

flowing fluid in a first direction through the diode such that fluid enters the diode through a low resistance entry of the diode and exits the diode through a high resistance entry of the diode, the high resistance entry having a concave annular surface surrounding an orifice; and flowing fluid in a second direction through the diode such that fluid enters the diode through the high resistance entry of the diode and encounters the concave annular surface prior to encountering the orifice, thereby restricting fluid flow through the diode.

12. A method as in claim 11, wherein the low resistance entry has a conical surface.

13. A method as in claim 11, further comprising flowing fluid through an autonomous fluid control system having a flow control assembly and a vortex assembly.

14. A method as in claim 13, further comprising flowing production fluid from the wellbore into the autonomous fluid control system.

15. A method as in claim 11, further comprising flowing fluid into the wellbore prior to or subsequent to flowing fluid from the wellbore.

16. A method as in claim 13, wherein the step of flowing fluid through an autonomous fluid control system occurs prior to the step of flowing fluid through the low resistance entry of the diode.

17. A method as in claim 11, further comprising the step of creating eddies in the fluid flow during the step of flowing fluid through the high resistance entry of the diode.

18. A method as in claim 17, wherein the eddies are created adjacent the concave, annular surface of the high resistance entry.

19. A method as in claim 11, wherein the concave, annular surface extends longitudinally beyond a plane defined by the orifice.

20. The method as in claim 11, wherein the fluid diode is disposed in a fluid passageway that is one of a pair of parallel passageways that extend between a common inlet where fluid may be divided into the pair of parallel passageways and respective outlets where fluid may be recombined from the pair of parallel passageways.

* * * * *